US009106025B2

(12) United States Patent
Brode et al.

(10) Patent No.: US 9,106,025 B2
(45) Date of Patent: Aug. 11, 2015

(54) SHIELDED CIRCULAR PLUG CONNECTOR UNIT WITH SYMMETRICALLY ARRANGED PLUG CONTACTS

(71) Applicant: CONINVERS GmbH, Herrenberg (DE)

(72) Inventors: Manfred Brode, Oeschelbronn (DE); Markus Michel, Nagold (DE)

(73) Assignee: Coninvers GmbH, Herrenberg (DE)

( * ) Notice: Subject to any disclaimer, the term of this patent is extended or adjusted under 35 U.S.C. 154(b) by 0 days.

(21) Appl. No.: 14/450,506

(22) Filed: Aug. 4, 2014

(65) Prior Publication Data

US 2015/0017840 A1 Jan. 15, 2015

Related U.S. Application Data

(63) Continuation of application No. PCT/EP2014/064581, filed on Jul. 8, 2014.

(30) Foreign Application Priority Data

Jul. 9, 2013 (EP) ..... 13175786

(51) Int. Cl.

| | |
|---|---|
| ***H01R 13/516*** | (2006.01) |
| ***H01R 13/6582*** | (2011.01) |
| ***H01R 13/6583*** | (2011.01) |
| ***H01R 24/86*** | (2011.01) |

(52) U.S. Cl.

CPC ..... *H01R 13/6582* (2013.01); *H01R 13/6583* (2013.01); *H01R 24/86* (2013.01)

(58) Field of Classification Search

CPC . H01R 13/6582; H01R 24/86; H01R 13/6583

USPC ..... 439/660, 680, 607.01, 607.27, 607.41, 439/607.48, 607.55–607.56

See application file for complete search history.

(56) References Cited

U.S. PATENT DOCUMENTS

| | | | | |
|---|---|---|---|---|
| 4,801,277 | A * | 1/1989 | Seilhan | 439/680 |
| 5,888,083 | A * | 3/1999 | Seilhan et al. | 439/161 |
| 6,488,537 | B1 * | 12/2002 | Wittmer et al. | 439/607.41 |
| 7,416,448 | B2 * | 8/2008 | Gaidosch | 439/607.41 |
| 2012/0329324 | A1 | 12/2012 | Hoeppner | |

FOREIGN PATENT DOCUMENTS

| | | | |
|---|---|---|---|
| DE | 102011056798 | A1 | 6/2013 |
| EP | 1274154 | A2 | 1/2003 |

* cited by examiner

*Primary Examiner* — Edwin A. Leon

(74) *Attorney, Agent, or Firm* — Von Rohrscheidt Patents

(57) ABSTRACT

A circular plug connector unit for shielded electrical cables, having an insulating body that is enveloped by a shielding sleeve, wherein plural electrical socket shaped plug contacts and/or pin shaped plug contacts are arranged in receiving cavities in the insulating body, wherein the shielding sleeve is interlocked with the insulating body. The plug side end of the shielding sleeve includes an even number of axially extending sleeve segments which are separated by longitudinal slots which are advantageously configured as sleeve segments that are short in axial direction and sleeve segments that are long in axial direction. Sleeve segments which are arranged in sequence advantageously have a uniform radial offset relative to each other in an alternating direction, wherein the sleeve segments of two identically configured shielding sleeves are insertable into one another with a rotational offset in circumferential direction of 360° divided by a number of the sleeve segments.

9 Claims, 3 Drawing Sheets

SHIELDED CIRCULAR PLUG CONNECTOR UNIT WITH SYMMETRICALLY ARRANGED PLUG CONTACTS

RELATED APPLICATIONS

This application is a continuation of International patent application PCT/EP2014/064581 filed on Jul. 8, 2014 claiming priority from European patent application 13 175 786.6 filed on Jul. 9, 2013, both of which are incorporated in their entirety by this reference.

FIELD OF THE INVENTION

The invention relates to a circular plug connector unit for shielded electrical cables including an insulating body enveloped by a shielding sleeve wherein plural electrical socket shaped or pin shaped plug contacts are arranged in receiving cavities in the insulating body, wherein the shielding sleeve is interlocked with the insulating body and inter-lockable with a receiving housing element of the plug connector, wherein the plug side end of the shielding sleeve includes an even number of axially extending sleeve segments that are separated from each other by longitudinal slots, wherein the sleeve segments that are sequentially arranged in a circumferential direction of the shielding sleeve respectively have a uniform a radial offset from one another in alternating directions, and wherein the sleeve segments of two identically configured shielding sleeves are insertable into one another for a rotational offset in circumferential direction of the shielding sleeves, wherein the rotational offset is 360° divided by the number of sleeve segments.

BACKGROUND OF THE INVENTION

A plurality of circular plug connectors in various configurations is known in the art. Known circular plug connectors include a plug element configured as an insulating body with contact elements supported therein for connecting strand conductors, wherein the plug element includes a cable connecting side and a plug side. When using shielded cables for signal transmission the insulating body is often enveloped by a shielding sleeve, in particular for plug connector housings that are not made from metal, wherein a shielding mesh of the cable is connectable with the shielding sleeve in order to conduct the shielding potential to an opposite plug. A circular plug connector unit of this type that is formed by the insulating body and by the shielding sleeve can for example be arranged in a circular plug connector that is provided for connecting signal conductors or for connecting power and signal conductors.

Is furthermore known to produce plug connectors as straight or angled plug connectors, wherein opposite plug connectors with identically arranged opposite contacts and an opposite shielding sleeves are respectively associated with the plug connectors. For the plug connector and the opposite plug connector typically different insulating bodies and different shielding sleeves are used which makes their production more expensive and increases inventory for these components.

Relevant art can be found in the printed documents EP 1 274 154 A2 and DE 10 2011 056 798 A1.

The printed document EP 1 274 154 A2 discloses a plug connector that is shielded with a shielding sleeve which includes a male connector element with a male plug contact and a female connector element with a female plug contact which are associated with one another, wherein the plug side end of the shielding sleeve includes two sleeve segments and thus an even number of axially extending sleeve segments that are separated from one another through longitudinal slots. One of the two sleeve segments adjoins a face of a body of the shielding sleeve without a radial offset, wherein the other sleeve segment has a radial offset from the first sleeve segment and the body of the shielding sleeve. The two plug connector elements are insertable into one another on the plug side with a rotational offset of 180°, wherein the sleeve segment with the radial offset reaches over the sleeve segment without the radial offset at its outer circumference. Thus, the shielding sleeves of the two connector elements are arranged relative to each other so that their center axes have a lateral offset from one another when the two shielding sleeves are identically configured and plugged into one another with a rotational offset. In order to compensate this offset at least the plug portions of the male and/or female plug contact are eccentrically arranged in the insulating bodies that are concentrically received in the shielding sleeves.

The printed document DE 10 2011 056 798 A1 teaches an electrical plug connector with an insulating housing into which a free end of a cable is inserted, including a first electrically conductive spring element which is arranged at a first portion of the free end of the cable, where the jacket is stripped, on the shielding enveloping the strands of the cable, including plural contact elements which are connected with the strands of the cable and including a shielding sleeve which envelops the first spring element, wherein the shielding sleeve is attached at the jacket of the cable in front and behind the first spring element. In the portion of the free end the shielding sleeve which is configured at the plug side end with a plurality of axially extending sleeve segments that are separated by longitudinal slots, includes engagement devices for attaching the plug connector at a wall, wherein the engagement devices are provided in the form of plural interlocking hooks that are configured in an annular manner at the face of the shielding sleeve. The plug connector can be connected in a contacting manner with an opposite plug that is arranged at a wall and which is advantageously arranged on a circuit board, wherein the engagement devices interlock behind the wall for attaching the plug connector at the opposite plug. The plug connector and the opposite plug are configured differently at least with reference to the shielding sleeve. The engagement devices configured at the sleeve segments of the shielding sleeve of the plug connector prevent that the same shielding sleeve can also be used for the opposite plug.

BRIEF SUMMARY OF THE INVENTION

Thus, it is an object of the invention to provide an insulating body and a shielding sleeve in order to reduce inventory wherein the insulating body and the shielding sleeve can be assembled to form a circular plug connector unit which is usable for the plug connector and also for the opposite plug connector so that these two embodiments can be manufactured in an economical manner.

The object is achieved according to the invention by a circular plug connector unit for shielded electrical cables including an insulating body that is enveloped by a shielding sleeve, wherein plural electrical socket shaped plug contacts and/or pin shaped plug contacts are arranged in receiving cavities in the insulating body, wherein the shielding sleeve is interlocked with the insulating body and interlockable with a receiving housing element of a plug connector housing, wherein a plug side end of the shielding sleeve includes an even number of axially extending sleeve segments which are separated by longitudinal slots, wherein the sleeve segments which are arranged in sequence in a circumferential direction of the shielding sleeve respectively have a uniform radial offset from each other in an alternating direction, wherein the sleeve segments of two identically configured shielding sleeves are insertable into one another with a rotational offset from each other in circumferential direction of the shielding sleeves, wherein the rotational offset is 360° divided by a number of the sleeve segments, wherein center axes of the insulating bodies respectively coincide with a center axis of the shielding sleeve and form a longitudinal axis of the circular plug connector unit when the insulating bodies are received in the shielding sleeve, wherein the even number of the sleeve segments is at least four, and wherein the longitudinal axes of the two circular plug connector units have no radial offset from each other due to the uniform radial offset of the sleeve segments when the shielding sleeves are inserted into each other. Additional advantageous embodiments can be derived from the dependent patent claims.

In the circular connector unit according to the invention the center axis of the insulating body received in the shielding sleeve respectively coincides with the center axis of the shielding sleeve and forms a longitudinal axis of the circular plug connector unit, wherein the center axes of the shielding sleeves and of the insulating bodies form a longitudinal axis of the assembled circular plug connector units when the shielding sleeves are inserted into one another and wherein according to the invention the even number of the axially extending sleeve segments that are separated by the longitudinal slots is at least four, so that the longitudinal axes of the two circular plug connector units do not have any radial offset from one another when the shielding sleeves are inserted into one another due to the uniform radial offset of the sleeve segments. The sleeve segments can thus extend absolutely in parallel or at a slight inclination to the connection side end of the shielding sleeve. Slightly inclined thus indicates an inclination angle of typically less than 5°, which is in particular advantageous for sleeve segments configured with spring elasticity. Thus, the shielding sleeve can establish a safe and reliable electrical contact with the opposite shielding sleeve. The radial offset of the sleeve segments which are arranged sequentially in circumferential direction of the shielding sleeve can thus be oriented radially inward or radially outward relative to the non-segmented segmented portion of the shielding sleeve. Thus, a distance of two respective sleeve segments that are directly sequential in circumferential direction differs relative to a center axis of the shielding sleeve by the same amount. This means that each first, third and optionally fifth sleeve segment counted in circumferential direction of the shielding sleeve is for example arranged along an inner circular path and each second, fourth and optionally sixth etc. sleeve segment is arranged along an outer circular path, wherein both paths extend concentric to the center axis of the shielding sleeve or vice versa. The distance of the two circular paths corresponds to the radial offset of the sleeve segments.

A width of the sleeve segments that is measured in circumferential direction of the shielding sleeve and of the longitudinal slots can thus be selected at will. Advantageously, however, embodiments of the invention are selected in which all sleeve segments and/or longitudinal slots have an identical width wherein each of the sleeve segments is arranged symmetrical to the center axis of the shielding sleeve and to each of the other sleeve segments. The sleeve segments are therefore uniformly distributed in circumferential direction of the shielding sleeve and arranged at the forward plug side and of the shielding sleeve.

In an advantageous embodiment of the invention the sleeve segments have an crank that is oriented radially inward and/or outward and which causes the offset. The cranked sleeve segments extend at least after the cranked location with an inclination angle relative to the center axis of the shielding sleeve of 5° at the most and essentially in axial direction. In one embodiment of the invention the sleeve segments that are more proximal to the center axis of the shielding sleeve are thus cranked inward, wherein the sleeve segments that are more remote from the center axis extend in a straight line or are cranked outward. Alternatively the sleeve segments that are more proximal to the center axis can also have no crank whatsoever and the sleeve segments that are further offset from the center axis can be cranked outward.

Advantageously the offset of the sleeve segments corresponds at least to the wall thickness of the shielding sleeve. In case the sleeve segments are advantageously configured spring elastic the offset of the inner and the outer sleeve segments can be slightly larger than the wall thickness of the shielding sleeve. For sleeve segments that are not configured spring elastic the radial offset of the sleeve segments corresponds to the wall thickness of the shielding sleeve.

In an advantageous embodiment of the invention the shielding sleeve includes short and long sleeve segments in axial direction which are arranged in alternating sequence in circumferential direction of the shielding sleeve. The short sleeve segments are generated for example through the cranks of each second sleeve segment when all sleeve segments are configured with identical axial lengths in front of the crank.

Through the measures described supra the sleeve segments of two identically configured shielding sleeves are insertable into one another for a particular rotational offset in circumferential direction, wherein the rotational offset is determined by 360° divided by the number of the sleeve segments. Thus, for example two identically configured sleeve sockets that have four sleeve segments can be inserted into one another on the plug side, when one of the shielding sleeves is rotated by 90° about the center axis of the shielding sleeve relative to the other shielding sleeve. When plugged together the respective outer sleeve segments of a rotated shielding sleeve reach over the respectively inner sleeve segments of the other shielding sleeve and the outer sleeve segments of the other shielding sleeve reach over the respective inner sleeve segments of the rotated shielding sleeve respectively on the outside. The respective sleeve segments thus contact each other mechanically and also safely contact each other electrically. Thus, a shielding sleeve configured in this manner can be used for a plug component and also for an opposite plug component when the opposite plug component is installed with a respective rotation angle offset in a suitable manner. Thus, plugging the shielding sleeves into one another on the plug side is easily provided. The suggested shielding sleeve is advantageously configured as a stamped and rolled component and therefore economical.

The circular plug connector unit according to the invention includes an insulating body that is received in the shielding sleeve, wherein the insulating body is arranged proximal to the plug side end of the shielding sleeve, recessed backward and interlocked with the shielding sleeve. The center axis of the insulating body coincides with the center axis of the shielding sleeve when the insulating body is received in the shielding sleeve and forms a longitudinal axis of the circular plug connector unit. The interlocked position of the insulating body and the shielding sleeve is thus selected so that the insulating bodys of two circular plug connector units which are configured for a plug component and for an opposite plug component do not impede one another when the shielding sleeve segments of the shielding sleeves are plugged into each other.

In an advantageous embodiment of the circular plug connector unit according to the invention the insulating body includes receiving cavities for the plug contacts which are arranged with an angular offset about a center axis of the insulating body, wherein the angular offset is 360° divided by the number of the sleeve segments. The angular offset of the receiving cavities of the insulating body corresponds to the rotational offset of the sleeve segments of the shielding sleeve with respect to the longitudinal axis of the circular plug connector unit. The symmetrical arrangement of the plug contacts in the insulating body corresponds to the symmetrical arrangement of the sleeve segments at the shielding sleeve. After aligning two circular plug connector units according to the invention so that the shielding sleeves are in insertable into one another with their plug side ends, the receiving cavities of the two insulating bodies, wherein a respective insulating body is respectively arranged in each shielding sleeve, extend in axial direction exactly in alignment with one another. Plug contacts that are introduced into the receiving cavities which plug contacts are arranged opposite to one another and configured as corresponding pin and socket electrical contacts of the plug connector and the opposite plug connector are thus easily insertable into one another. Thus, the sleeve segments furthermore function as coding elements of the circular probe plug connector which reliably prevent a pole reversal. Instead of a single receiving cavity that is associated with each sleeve segment also plural receiving cavities can be associated with each sleeve segment which form a cavity group wherein the receiving cavity groups are arranged rotation symmetrical with respect to the center axis of the insulating body like the individual receiving cavities.

Advantageously the receiving cavities of the insulating bodys are configured so that they can receive pin shaped and also socket shaped plug contacts. Thus, the same insulating body can be used for the plug element and also for the opposite plug element. Thus, the insulating body can be configured in one piece or in plural pieces, wherein the insulating body is insertable from the cable connection side into the shielding sleeve with plug contacts arranged in the receiving cavities that are connected with the strands of the cable. For integrally configured insulating bodies the plug contacts can be introduced into the insulating body in axial direction from behind. For insulating bodies that are configured in plural pieces the plug contacts are inserted into the insulating body as usual in a radial direction wherein the insulating body is then joined with at least one additional insulating body. Thus, for an application as plug element only the pin shaped plug contacts can be introduced into the insulating body and for an application as opposite plug element only socket shaped plug contacts can be introduced into the insulating body or for a suitable arrangement optionally pin and socket shaped plug contacts can be introduced in a mixed arrangement. The shield connection can be implemented in a simple and known manner with spring elastic elements that are integrated in the plug housing. A circular plug connector unit of this type can be installed in circular plug connectors that are used for power and/or signal transmission and the circular plug connector unit can be interlocked with the receiving housing component of the circular plug connector.

BRIEF DESCRIPTION OF THE DRAWINGS

The invention is subsequently described with reference to an embodiment illustrated in the drawing Figure. Additional features of the invention can be derived from the subsequent description of an embodiment of the invention in combination with the patent claims and the appended drawing Figure. The individual features of the invention can be implemented by themselves or in groups in different embodiments of the invention.

DETAILED DESCRIPTION OF THE INVENTION

Figure 1:
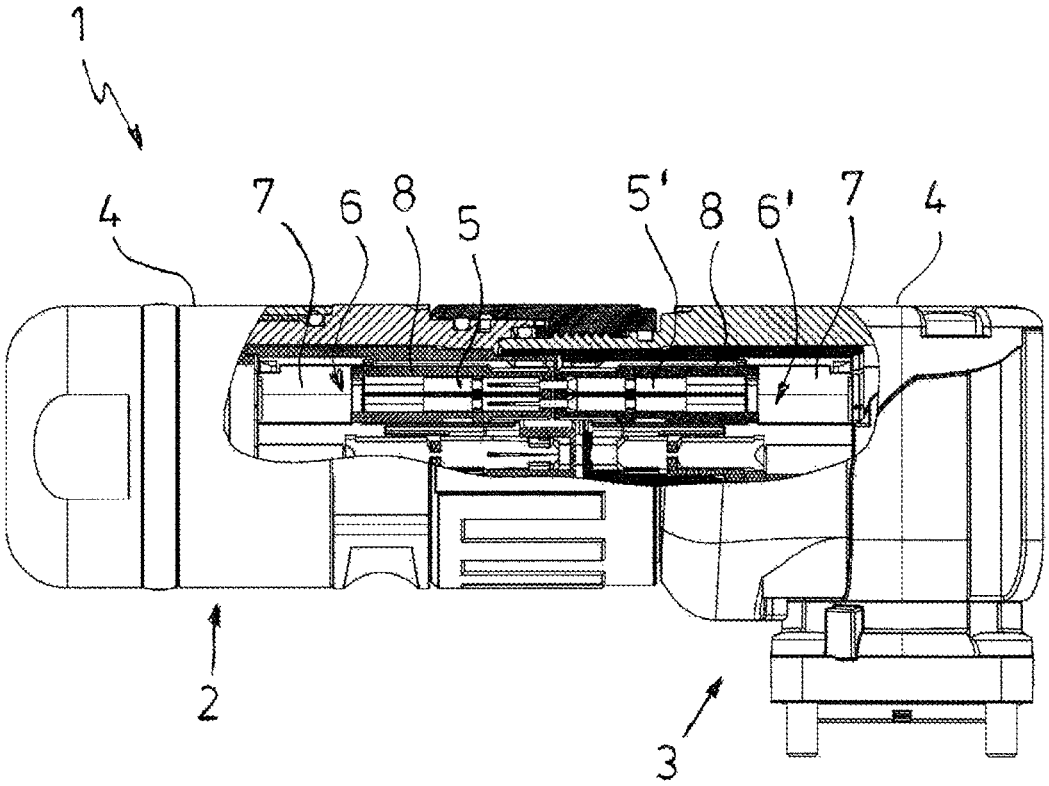
FIG. 1 illustrates a hybrid plug connector with a plug element and an opposite plug element which respectively include a circular plug connector unit according to the invention.

FIG. 1 illustrates a hybrid plug connector unit 1 with a plug connector 2 and an opposite plug connector 3 in plugged together condition in a partial longitudinal sectional view. The plug connector 2 is configured as a straight circular plug connector and the opposite plug connector 3 is configured as an angled circular plug connector. Both plug connectors include a metal plug connector and housing 4 in which non-illustrated power transmitting plug connector contacts and illustrated signal transmitting plug contacts 5, 5' are arranged. The signal transmitting plug contacts 5, 5' are arranged in circular plug connector units 6, 6', wherein the circular plug connector unit 6 which is associated with the plug connector 2 includes sleeve shaped plug contacts 5 and the circular plug connector unit 6' which is associated with the opposite plug connector 3 includes pin shaped plug contacts 5'. The circular plug connector units 6, 6 respectively include a shielding sleeve 7 and an insulating body 8 which are interlocked with each other.

Figure 2:
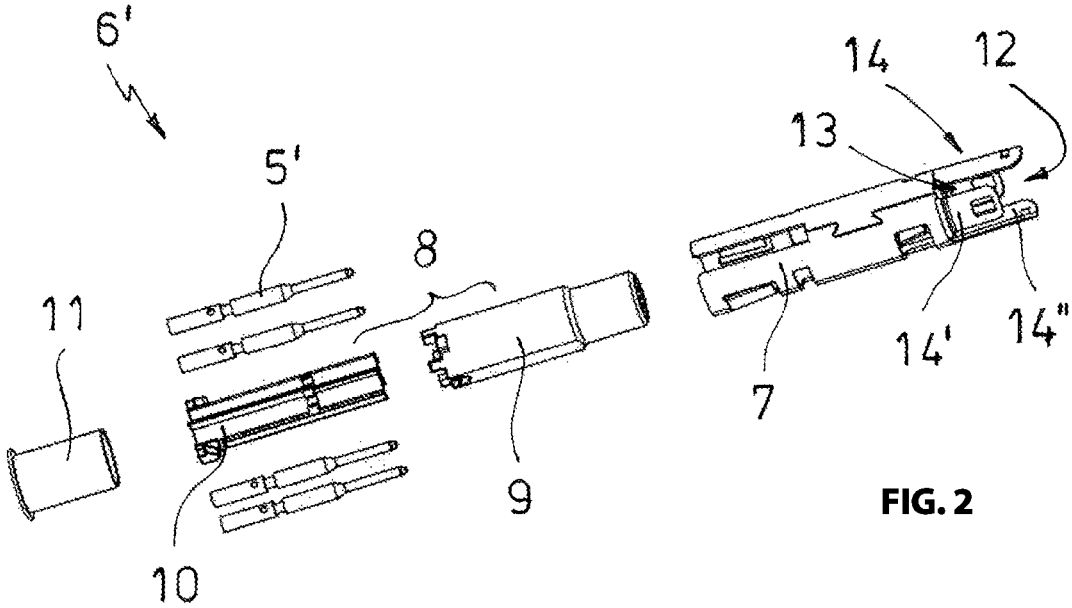
FIG. 2 illustrates a circular plug connector unit according to the invention according to FIG. 1 in an exploded view.

FIG. 2 illustrates one of the circular plug connector units 6, 6' of FIG. 1 in an exploded view. The illustrated circular connector unit 6' includes a two-piece insulating body 8 with a pot shaped insulating body sleeve 9 and an insulating contact carrier 10 that is insertable into the insulating body sleeve 9 from the cable connection side. The pin shaped plug contacts 5' can be inserted into the contact carrier 10 with the non-illustrated connected strands of a shielded cable. The contact carrier 10 can then be inserted into the insulation element sleeve 9 and interlocked therewith. The insulation element 8 thus formed is insertable into the shielding sleeve 7 axially from behind, wherein the shielding sleeve 7 is advantageously configured as a rolled stamped component. The cable shield of the shielded electrical cable which is not illustrated in the drawing figure is connectable with the shielding sleeve 7 through a shield contact sleeve 11. The circular plug connector unit 6 is configured accordingly, wherein the difference is only in the inserted bushing shaped plug contacts 5.

Figure 3A:
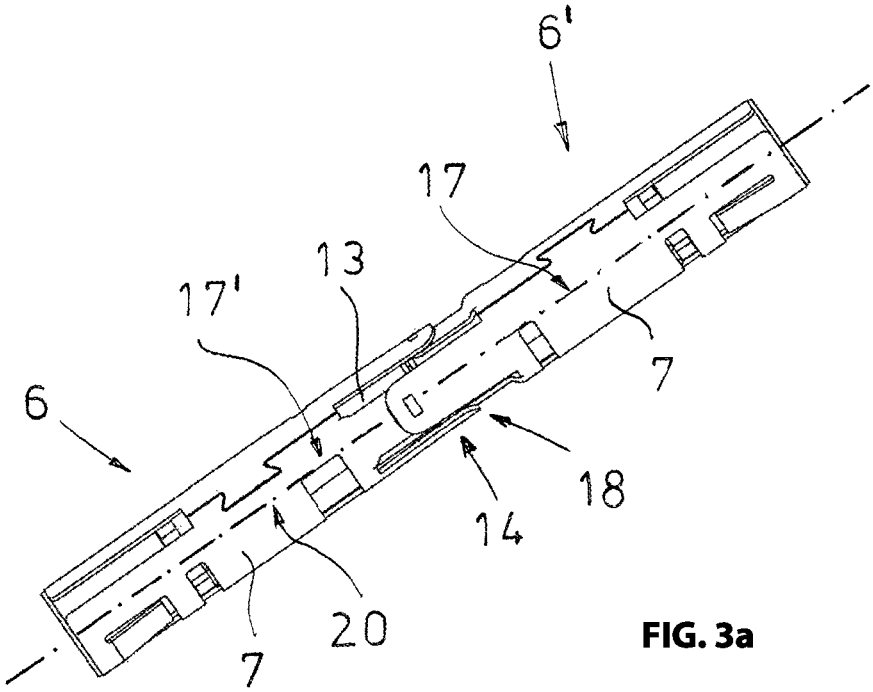
FIGS. 3*a* and 3*b* illustrates the two assembled circular connector units of FIG. 1 in a lateral view in assembled condition (FIG. 3*a*) and pulled apart (FIG. 3*b*)
Figure 3B:
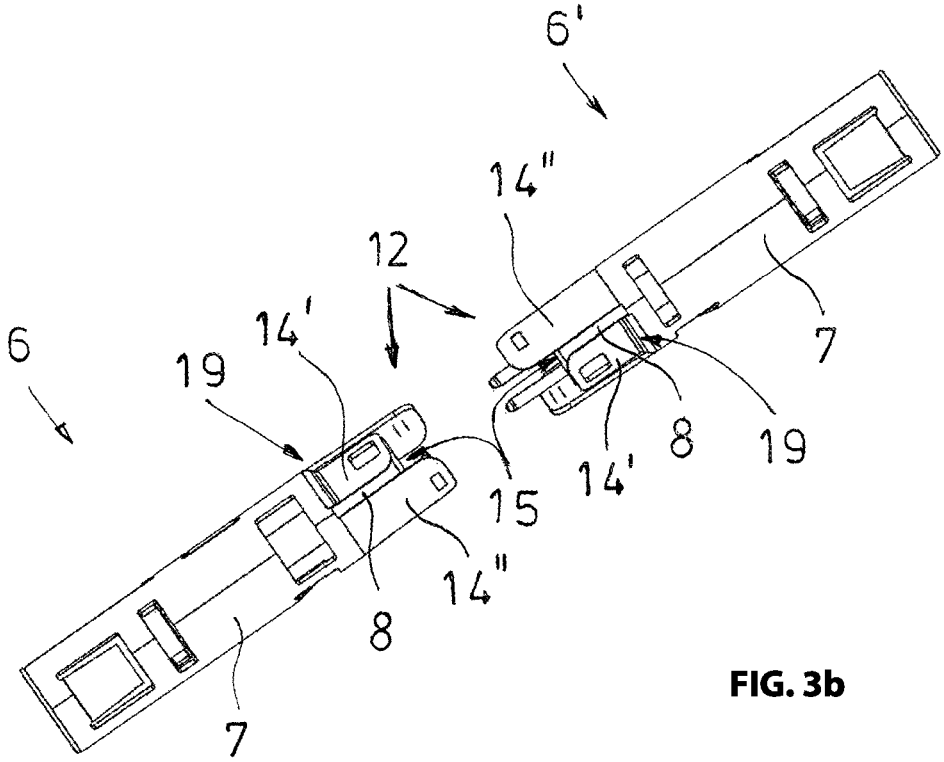

FIGS. 3*a*, 3*b* illustrates the circular plug connector units 6, 6' according to the invention in plugged together condition (FIG. 3*a*) and pulled apart (FIG. 3*b*). In particular FIG. 3*b* clearly shows that the plug side end 12 of the shielding sleeve 7 has an even number, in this case four axially extending sleeve elements 14 which are separated by longitudinal slots 13. The sleeve segments 14 respectively include two short sleeve segments 14' and two long sleeve segments 14" which are arranged in sequence in circumferential direction of the shielding sleeve 7. A short sleeve segment 14' is arranged subsequent to a long sleeve seen segment 14" and then again a long sleeve segment 14" that is a joined by a short sleeve segment 14'. The sleeve segments 14 are arranged in a circle about a center axis 17 of the shielding sleeve 7, wherein the short sleeve segments 14' respectively have a uniform a radial offset 18 in inward direction with respect to the long sleeve segments 14". The offset 18 extends in alternating direction with respect to the sleeve segments 14' and 14". The offset is oriented in an alternating manner for the sleeve segments 14 in inward and in outward direction.

In the illustrated embodiment of the circular plug connector units 6 or 6' the short sleeve segments 14' include an crank 19 that is oriented inward and causes the offset 18 between the long sleeve segments 14" and the short sleeve segments 14'. The offset 18 of sequential sleeve segments 14 approximately corresponds to the wall thickness of the shielding sleeve 7, wherein the short the sleeve segments 14' are advantageously configured spring elastic due to the crank. Insulating bodies 8 are respectively received in the shielding sleeves 7, wherein plug side ends 15 of the insulating bodies are arranged at a free end of the short sleeve segments 14'. Pin shaped plug contacts 5' protrude from the insulating body 8 of the circular plug connector unit 6' of the opposite plug connector 3. The socket shaped plug contacts 5 that are received in the insulating body 8 of the circular plug connector unit 6 of the plug connector 2 are not visible in FIG. 3*b*.

The circular plug connector units 6, 6' are arranged rotated relative to one another by 90° about the longitudinal axis 20 of the circular plug connector units 6, 6'. The short sleeve segments 14' of the sleeve jacket 7 of the circular plug connector units 6, 6' are respectively arranged directly adjacent to the long sleeve segment 14" of the respective other shielding sleeve 7 and vice versa. Thus, the sleeve segments 14', 14" with the adjacent longitudinal slots 13 respectively have identical width in circumferential direction of the shielding sleeve 7. Consequently both shielding sleeves 7 as illustrated in FIG. 3*a* are insertable into one another until the insulating bodies 8 contact each other. In this condition the pin shaped plug contacts 5' engage the socket shaped plug contacts 5 as illustrated in FIG. 1. In the plugged together condition of the two circular plug connector units 6, 6' the long sleeve segments 14" respectively reach over the short sleeve segments 14' and contact them electrically.

Figure 4:
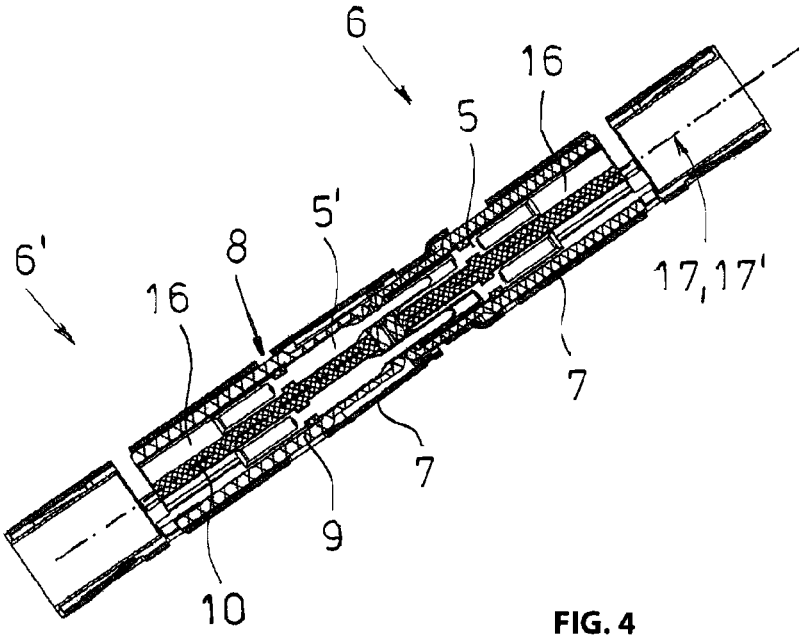
FIG. 4 illustrates the plug together circular plug connector units of FIG. 1 in a longitudinal sectional view.

This can also be derived from FIG. 4 which illustrates the circular plug connector units 6, 6' that are plugged into one another in a longitudinal sectional view. This Figure also clearly illustrates the contact carrier 10 arranged in the insulating body sleeve 9 of the insulating body 8. The contact carrier 10 includes receiving cavities 16 which are configured so that they can receive pin shaped and also socket shaped plug contacts 5, 5'. The receiving cavities 16 are thus a rotation symmetrical with respect to the center axis 17, 17' of the insulating body 8 and thus arranged about a longitudinal axis 20 of the circular plug connector units 6, 6' so that the pole configuration is maintained also when one of the circular plug connector unit 6, 6' is rotated by 90°, wherein the angle is defined by dividing 360° by 4 corresponding to the number of sleeve segments 14 provided in the embodiment. It is appreciated that plug contacts 5, 5' can also be arranged in the center axis 17, 17'.

What is claimed is:

1. A circular plug connector unit for shielded electrical cables, comprising: an insulating body that is enveloped by a shielding sleeve, wherein plural electrical socket shaped plug contacts or pin shaped plug contacts are arranged in receiving cavities in the insulating body, wherein the shielding sleeve is interlocked with the insulating body and interlockable with a receiving housing element of a plug connector housing, wherein a plug side end of the shielding sleeve includes an even number of axially extending sleeve segments which are separated by longitudinal slots, wherein the sleeve segments which are arranged in sequence in a circumferential direction of the shielding sleeve respectively have a uniform radial offset from each other in an alternating direction, wherein the sleeve segments of two identically configured shielding sleeves are insertable into one another with a rotational offset from each other in circumferential direction of the shielding sleeves, wherein the rotational offset is 360° divided by a number of the sleeve segments, wherein center axes of the insulating body respectively coincide with a center axis of the shielding sleeve and form a longitudinal axis of the circular plug connector unit when the insulating body are received in the shielding sleeve, wherein the even number of the sleeve segments is at least four, and wherein the longitudinal axes of the two circular plug connector units have no radial offset from each other due to the uniform radial offset of the sleeve segments when the shielding sleeves are inserted into each other.

2. The circular plug connector unit according to claim 1, wherein the sleeve segments have a crank which is oriented radially inward and/or radially outward and causes the offset.

3. The circular plug connector unit according to claim 2, wherein the offset of the sleeve segments corresponds at least to a wall thickness of the shielding sleeve.

4. The circular plug connector unit according to claim 1, wherein the sleeve segments are at least partially configured spring elastic.

5. The circular plug connector unit according to claim 1, wherein the shielding sleeve includes sleeve segments that are short in axial direction and sleeve segments that are long in axial direction, wherein the sleeve segments are arranged in an alternating sequential pattern in a circumferential direction of the shielding sleeve.

6. The circular plug connector unit according to claim 1, wherein the insulating body includes receiving cavities for the plug contacts which are arranged about a center axis of the insulating body with an angular offset of 360° divided by the number of the sleeve segments.

7. The circular plug connector unit according to claim 1, wherein the receiving cavities are configured so that pin shaped and also socket shaped plug contacts are receivable therein.

8. The circular plug connector unit according to claim 1, wherein the circular plug connector unit is installed or installable in a circular plug connector including power conductors and/or signal conductors.

9. A circular plug connector unit for shielded electrical cables, comprising: an insulating body that is enveloped by a shielding sleeve, wherein plural electrical socket shaped plug contacts and pin shaped plug contacts are arranged in receiving cavities in the insulating body, wherein the shielding sleeve is interlocked with the insulating body and interlockable with a receiving housing element of a plug connector housing, wherein a plug side end of the shielding sleeve includes an even number of axially extending sleeve segments which are separated by longitudinal slots, wherein the sleeve segments which are arranged in sequence in a circumferential direction of the shielding sleeve respectively have a uniform radial offset from each other in an alternating direction, wherein the sleeve segments of two identically configured shielding sleeves are insertable into one another with a rotational offset from each other in circumferential direction of the shielding sleeves, wherein the rotational offset is 360° divided by a number of the sleeve segments, wherein center axes of the insulating body respectively coincide with a center axis of the shielding sleeve and form a longitudinal axis of the circular plug connector unit when the insulating body are received in the shielding sleeve, wherein the even number of the sleeve segments is at least four, and wherein the longitudinal axes of the two circular plug connector units have no radial offset from each other due to the uniform radial offset of the sleeve segments when the shielding sleeves are inserted into each other.

* * * * *